United States Patent [19]

Scott

[11] Patent Number: 4,905,333

[45] Date of Patent: Mar. 6, 1990

[54] SPRING BEDDING PRODUCT

[75] Inventor: Terence A. Scott, Carthage, Mo.

[73] Assignee: Leggett & Platt, Incorporated, Carthage, Mo.

[21] Appl. No.: 237,775

[22] Filed: Aug. 29, 1988

[51] Int. Cl.[4] ..... A47C 27/04

[52] U.S. Cl. ..... 5/475; 5/248; 5/267; 267/97

[58] Field of Search ..... 5/255, 256, 247, 248, 5/475, 476, 267, 268; 267/91, 97, 105, 110

[56] References Cited

U.S. PATENT DOCUMENTS

| | | | |
|---|---|---|---|
| 32,352 | 5/1861 | Cook | 5/247 |
| 2,637,858 | 5/1953 | Goldberg | 5/267 |
| 3,479,672 | 11/1969 | Haney et al. | 267/97 |

FOREIGN PATENT DOCUMENTS

| | | | |
|---|---|---|---|
| 1147724 | 4/1963 | Fed. Rep. of Germany | 5/475 |
| 1155218 | 10/1963 | Fed. Rep. of Germany | 5/475 |
| 1503723 | 12/1967 | France | 5/475 |
| 1104884 | 3/1968 | United Kingdom . | |
| 2143731B | 11/1986 | United Kingdom . | |

*Primary Examiner*—Gary L. Smith
*Assistant Examiner*—Michael Milano
*Attorney, Agent, or Firm*—Wood, Herron & Evans

[57] ABSTRACT

A spring interior comprising a plurality of longitudinally extending bands of springs disposed side by side and connected together by helical lacing wires in the top and bottom faces of the bands. Each band of springs comprises a single length of wire formed into a plurality of substantially vertical interconnected by interconnecting segments of wire coils of springs located alternately in the top and bottom faces of the bands. Each interconnecting segment comprises a longitudinally extending bridging portion and a transversely extending padding support structure. The padding support structure is angled upwardly away from the top face of the band and downwardly away from the bottom face of the band so as to impart initial softness and subsequent increased firmness to the spring interior when the spring unit is vertically compressed.

14 Claims, 3 Drawing Sheets

SPRING BEDDING PRODUCT

This invention relates to spring interiors, and specifically to spring interiors for bedding products, such as mattresses and the like.

A known form of spring interior comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, which is the subject of British Patent No. 1,104,884, will hereinafter be referred to as a band of interlocked springs. It comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotational hand of the adjacent coils immediately before and after it in the row, and being joined to the adjacent coil springs by a pair of interconnecting segments of wire integral with the coil springs. One of the pair of interconnecting segments is located in the bottom face of the band, and the other of the pair of interconnecting segments is located in the top face of the band. Each interconnecting segment comprises a bridging portion between adjacent coils, which bridging portion extends lengthwise of the row.

When bands of interlocked springs of the type described hereinabove and more completely described in the above-identified British patent are assembled together to form a spring interior, they are disposed side by side and interconnected by helical wires, some of which lie in the top face of the spring interior and others of which lie in the bottom face thereof, the top and bottom faces of the spring interior being the faces defined by the top and bottom faces of the bands incorporated in the spring interior. Each helical wire extends across the bands of springs and embraces portions of wires of the bands that extend transversely of the bands from the ends of the bridging portions of the links. In the top face of the spring interior the helical wires are disposed at uniform intervals along the bands of springs, the arrangement being such that there are two springs disposed in the interval between each helical wire and the next. There is a similar arrangement in the bottom face of the spring interior.

BACKGROUND OF THE INVENTION

The bands incorporated in such spring interiors have been such that the bridging portion of each interconnecting segment is rectilinear and lies at or near the place where a side face of the band meets the top or bottom face thereof. When bands of springs of that design are incorporated in spring interiors, the bridging portion of each link therefore extends from one helical wire to the next in a direction at right angles to the helical wires.

It will be appreciated from the foregoing description that the top face of a spring interior assembled in this way has the general appearance of a rectangular grid. Each of the transverse elements of the grid comprises a helical wire, and each of the longitudinal elements of the grid comprises a row of mutually aligned bridging portions. Within the confines of each rectangle of the grid and disposed a little lower than the grid are the upper end portions of two adjacent coil springs, those two springs constituting parts of the same band of springs. The bottom face of the spring interior is, of course, similar to the top face, though inverted.

In this description of the invention there are references to faces of bands of springs and of spring interiors. As the bands of springs and spring interiors are, of course, of open-work or skeletal form, the term "face" must be understood as referring to an imaginary surface defined by the relevant parts of the bands or spring interiors. Furthermore, as the wires and helical wires are of finite width or thickness and as they sometimes overlap each other, the term "face" cannot be understood as having a strictly geometrical meaning. Nevertheless, as the faces concerned are relatively extensive and are of flat shape, their locations can in practice be determined without difficulty or ambiguity.

It is customary for a spring interior to be incorporated in an upholstered article. In such an article at least one of the main faces of the spring interior (that is the top and bottom faces thereof) is covered by a layer or layers of padding. This in turn may be covered by a cover made of sheet material such as ticking or upholstery fabric. In use, when pressure is applied to an upholstered face of such an article the filling is pressed towards the spring interior, and in the absence of any additional support tends to enter the rectangular openings in the grid. When the thickness of the filling is relatively small as compared with the dimensions of each rectangular grid openings the upholstery tends to be deformed in such a way that the pattern of the grid forms relatively unyielding ridges in the cover and can be felt by the user. This entry of the filling into the spring interior is a typical example of a phenomenon known in the trade as "cupping."

One method commonly employed to prevent or reduce "cupping" is the provision of a flexible diaphragm or separator between the spring interior and the filling. The diaphragm or separator may comprise a sheet of flexible but inextensible fabric or it may comprise a sheet of mesh. One type of mesh that is widely used comprises a plurality of uniformly spaced parallel cords of twisted paper or plastic strip traversed at right angles by a plurality of uniformly spaced, parallel resilient wires, the wires piercing all the cords except the two marginal cords, and end portions of the wires being shaped to form tight loops or eyes embracing the marginal cords. The rectangular apertures in such a mesh are considerably smaller than those in the grids of the top and bottom faces of the spring interior so that any tendency for "cupping" is much reduced.

British Patent No. 2,143,731 describes a spring interior comprising a plurality of bands of interlocked springs wherein the bands are disposed side by side so that their top faces lie in a top main face of the spring interior and their bottom faces lie in a bottom main face of the spring interior. The bands of springs are interconnected by helical wires lying in the top and bottom faces of the bands and extending across the bands with each helical wire embracing portions of wires of the bands that extend transversely of the bands. The adjacent coils of each band are interconnected by interconnecting segments of the wire from which the band is formed. These interconnecting segments have bridging portions which extend lengthwise of the row of coils of the band. These bridging portions are shaped so as to extend not only longitudinally of the bands but also laterally thereof, the laterally extending portions constituting supporting structures for supporting padding and for preventing "cupping" of the padding. When padding or other upholstery material is disposed against a face containing those supporting structures, there is a reduction in any tendency there might otherwise be for the padding to enter the band through that face when forces are applied to the material in a direction or directions such as to compress the coil springs incorporated in the band.

A characteristic of the spring interior described in British Patent No. 2,143,731, as well as most spring interiors, is that they are of relatively constant firmness throughout the deflection of the springs of the interior. Otherwise expressed, a "firm" spring interior is firm throughout the deflection of the spring interior and a "soft" spring interior is "soft" throughout the deflection of the springs of the interior. But ideally, for many bedding applications, a spring should be "soft" or relatively easily deflected for the first increment, as for example, the first one inch, of deflection for a soft feel and thereafter firm for good body support. But the nature of most springs is that they do not lend themselves to this type of deflection pattern. Accordingly, prior art practice has been to provide a relatively thick, soft pad atop the spring mattress, which pad provides the initial "soft" feel of the resulting padded spring interior.

It has therefore been one objective of this invention to provide a spring interior which has an initial "soft" deflection followed by a much firmer deflection provided by the springs of the interior rather than padding. More specifically, it has been an objective of this invention to provide a spring pattern manufactured in accordance with the description contained in the above-identified British patent, but with an initial soft feel or initial soft deflection of the spring interior provided by the springs and not by a thick and expensive pad covering the spring interior.

SUMMARY OF THE INVENTION

These objectives have been accomplished according to the practice of this invention by angling the supporting structure of the bridging portions of the spring which interconnect adjacent coils such that the supporting structure extends upwardly from the bridging portions in the top face or top plane of the bedding unit and extends downwardly from the bridging portions between adjacent coils in the plane of the lower face of the spring interior. This angling of the supporting structure to an angle of approximately 15–30 degrees either upwardly from the plane or face of the top of the bedding unit and downwardly from the bottom face or plane of the spring interior markedly softens the initial firmness of the resulting unit without appreciably increasing the cost of the unit. In practice, this supporting structure extends upwardly into the padding which is contained beneath the upholstered covering of the unit but without imparting substantial planar changes to the upholstered covering. When a compressive force is applied to the spring interior, the supporting structure must first be deflected downwardly into the top plane or upwardly into the bottom plane of the interior unit, which deflection effects torsional deflection of the bridging portions of the spring interior before there is any compressive deflection of the coils of the spring unit. This torsional deflection of the bridging portions acts as a relatively soft preload which must be applied to the spring interior before any appreciable deflection of the top face of the spring interior occurs. As a result, the spring interior has an initial soft feel or deflection which is not present when the supporting structure is located in the plane of the top face of the unit as in the above-identified British patent.

One advantage of this angling of the supporting structure from the plane of the top face or bottom face of the spring interior is that it provides initial softness or a soft feel of the spring assembly without the need for a heavy, thick, and relatively expensive, pad over the spring assembly to provide the initial softness. The use of this angling of the supporting structure from the top face or bottom face of the spring interior has an additional advantage over a relatively expensive pad customarily applied over a spring assembly to provide the initial softness in that the angled supporting structure has a much higher degree of remembrance and longevity than the thick fabric pad. Fabric tends to compress and thereby lose its resiliency or remembrance, but the angled supporting structure of this invention is not subject to such loss of resiliency or remembrance.

Yet another advantage of this invention of this application is that it provides a means of increasing the height of spring product without the need for expensive fill materials or additional spring wire to achieve that increased height. Heretofore, such increased height has usually been provided by increasing the thickness of the fill material and then substantially increasing the cost of the resulting product.

Each supporting structure, whether angled upwardly from the top face of the band of springs or downwardly from the bottom face of the band of springs, may be of any of a wide variety of different shapes. It is, of course, desirable that the supporting structure should provide adequate padding support without requiring the use of more spring wire than is necessary and that the support should be afforded in a suitable position or positions. As far as this latter consideration is concerned it is often desirable to provide a supporting structure half way between the ends of the bridging portion of which it forms a part so that in a spring interior it lies half way between adjacent helical wires. Similarly, it is often desirable for the supporting structure to be disposed substantially symmetrically with respect to the longitudinal center line of the top or bottom face of the band of springs of which it forms a part; preferably, it extends more than half way across the top or bottom face of the band, and more preferably for at least three quarters of the way across the band. The supporting structure may be in the shape of a semi-circle or other arc, or it may comprise a pair of straight portions inclined to each other to form a V. Alternatively, it may be of sinuous or zig-zag form; for example, it may be shaped to resemble the letter W. Yet another alternative is to form the supporting structure in the shape of a loop or loops of wire lying in the top or bottom face of the band.

The present invention will now be described in more detail, by way of example, with reference to the accompanying drawings, in which.

Figure 1:
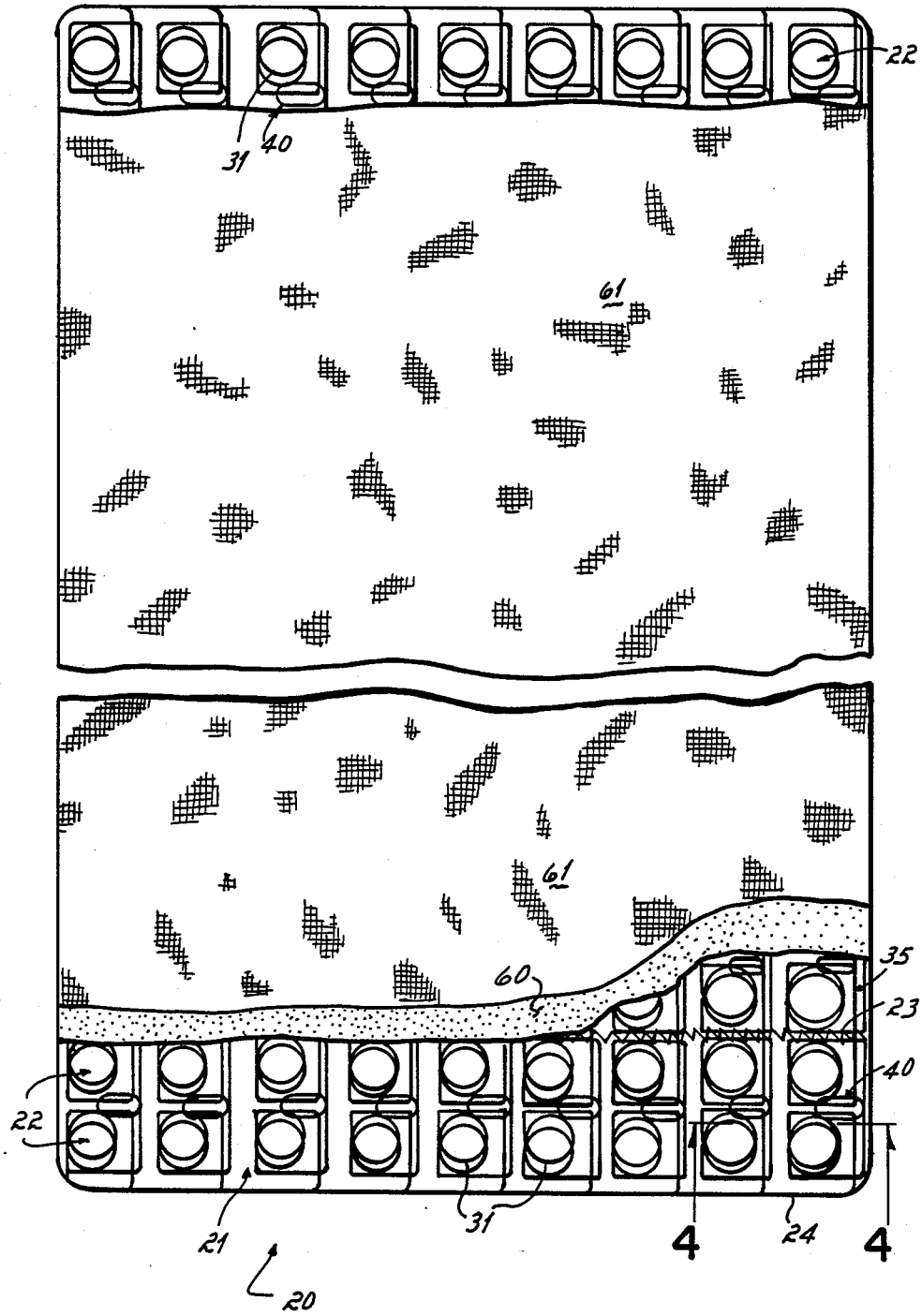
FIG. 1 is a top plan view partially broken away of a mattress incorporating the invention of this application.
Figure 2:
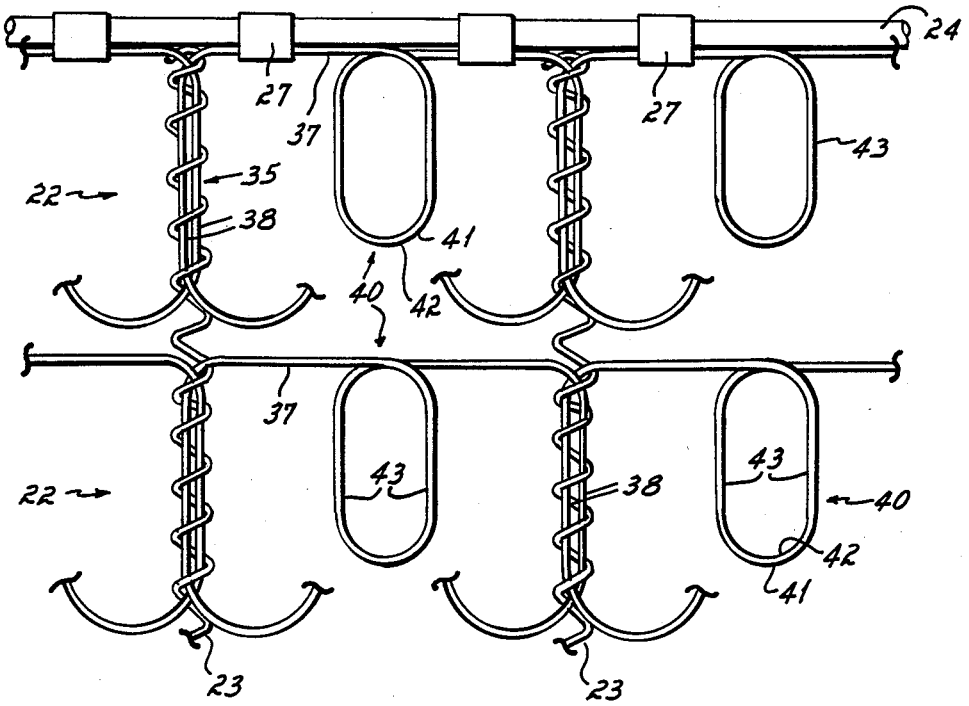
FIG. 2 is an enlarged top plan view of a portion of two bands or rows of springs embodied in the mattress of FIG. 1.
Figure 3:
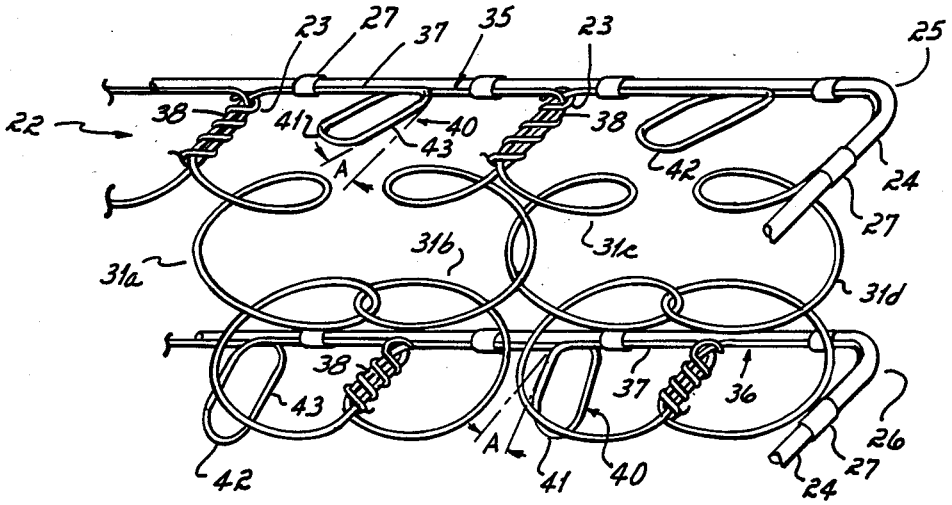
FIG. 3 is a perspective view of one corner of the mattress of FIG. 1.

With reference first to FIGS. 1-3, there is illustrated a mattress 20 embodying the invention of this application. This mattress comprises a spring interior 21 formed from a plurality of bands of springs 22 which extend longitudinally of the mattress. These bands of springs 22 are laced together by helical lacing wires 23 which extend transversely of the spring interior and secure the bands of springs in an assembled relation. A border wire 24 extends completely around the periphery of the spring interior in the top and bottom planes 25, 26, respectively, of the interior and is secured to the outermost edge of the spring interior in these planes by conventional sheet metal clips 27.

Each band of springs 22, a portion of one of which is illustrated in FIG. 3, is made from a single length of spring wire shaped to form a plurality of individual coil springs 31 arranged in a row. Each coil spring 31 comprises about two and one-half turns of wire. The axis of each coil spring is not upright but is inclined lengthwise of the band, each spring being inclined in a direction opposite to that in which its two immediate neighbors in the row are inclined. The end turns of the coil springs 31 lie adjacent to the top and bottom faces 25, 26 of the band. Each coil spring, such as that numbered 31*b*, is so coiled as to have a hand opposite to the hand of the adjacent coil springs, such as 31*a* and 31*c*, immediately before and after it in the row. Each coil spring is joined to the next adjacent coil springs by two interconnecting segments 35, 36 of the wire integral with the coil springs. One of the two interconnecting segments 35, 36 is in the top face 25 of the band 22 and the other is in the bottom face 26 thereof. For example, coil spring 31*a* is connected to spring 31*b* by interconnecting segment 35, which is in the top face of the band, and the coil spring 31*b* is connected to coil spring 31*c* by interconnecting segment 36, which is in the bottom face of the band. Each interconnecting segment 35, 36 comprises a bridging portion 37, which extends longitudinally of the row of coil springs and end portions 38 which extend in a direction normal to the longitudinal axis of the band 22. Those end portions 38 of the interconnecting segments 35, 36 also lie in the top and bottom faces 25, 26 of the band 22.

In the band 22 illustrated in FIGS. 1-4, the location of the intersection between each end 38 of each coil spring 31*a*, 31*b*, 31*c* or 31*d* and the associated end portion of the interconnecting segments 35, 36 is well defined, for the coils springs are curved and the end portions 38 of the interconnecting segments are straight. In other constructions, however, the intersections may be less well defined because the end portions 38 of the interconnecting segments 35, 36 may be replaced by arcuate extensions of the coil springs 31*a*, 31*b*, 31*c* or 31*d*; in those last cases the interconnecting segments must be considered as consisting solely of the bridging portions 37.

Each bridging portion 37, in addition to extending longitudinally of the band, also extends laterally thereof to form a supporting structure 40. In the embodiment of FIGS. 1-4, the supporting structure 40 is in the form of a loop 41 of wire lying in the top 25 or bottom face 26 of the band 22, as the case may be, and extending to one side of the remainder of the bridging portion 37 of which it forms a part. Each loop 41 lies half way between the end portions 38 of the interconnecting segment of which it forms a part and it extends from one side face of the band to a location a little way short of the other side face thereof, though rather more than three quarters of the way across the band. Each loop 41 includes a semicircular central part 42 which joins parallel, rectilinear limbs 43 parallel with the end portions 38. It will be observed that all of the loops 41 in the top face 25 of the band 22 are of one hand while all the loops 41 in the bottom face 26 of the band 22 are of the other hand.

The method of manufacturing and the apparatus for manufacturing the band of springs illustrated in FIG. 3 is completely described and illustrated in British Patent No. 2,143,731. After the rows of coil springs are formed, each coil spring is coupled with the next by having an intermediate turn thereof passed round an intermediate turn of the next spring. This coupling can be carried out mechanically or manually. The coil springs 31*a*, 31*b*, 31*c*, 31*d* illustrated in FIG. 3 are coupled in this manner.

Figure 4:
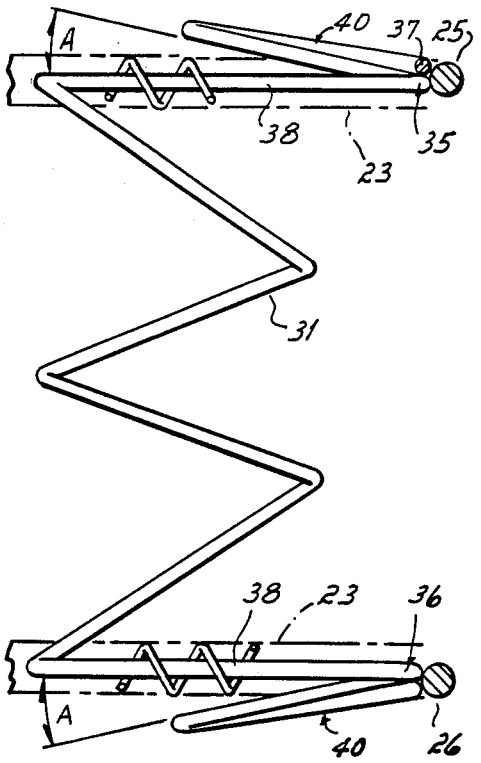
FIG. 4 is a cross-sectional view through a band of springs taken on line 4—4 of FIG. 1.

As seen in FIGS. 3 and 4, in accordance with the practice of the invention of this application, the supporting structure 40 extends at an angle A upwardly from the plane 25 of the top face of the band 22 and downwardly from the plane 26 from the lower face of the band. The purpose of this angulation of the supporting structure 40 is to increase the initial softness or ease of deflection of the band without appreciably increasing the cost of either the material or of manufacture of the band. When the band is depressed, as for example, when it is embodied in a spring interior of a mattress and a person lies down upon the top of the mattress, the supporting structure 40 must first depress into the planes 25, 26 of the top face and bottom face of the band of coil springs. This initial deflection occurs as a consequence of torsional bending of the bridging portion 37 of the interconnecting segment of the band of springs. Only after this torsional bending of the bridging portion 37 does the coil spring 31*a*, 31*b*, 31*c* or 31*d* of the band appreciably compress. As a result, the spring unit embodying these angularly oriented supporting structures 40 is substantially "softer" initially and then as firm as the same spring interior 21 made with the supporting structure located in the top and bottom planes of the spring unit, as in British Patent No. 2,143,731.

Figure 5:
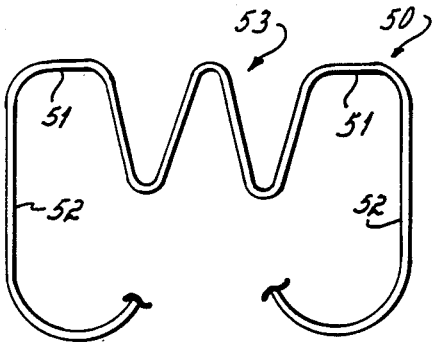
FIG. 5 is a top plan view of a modified version of the interconnecting segment between two adjacent coils of springs in a band of springs similar to the band of FIG. 2 but incorporating a modified supporting structure of the interconnecting segment.
Figure 6:
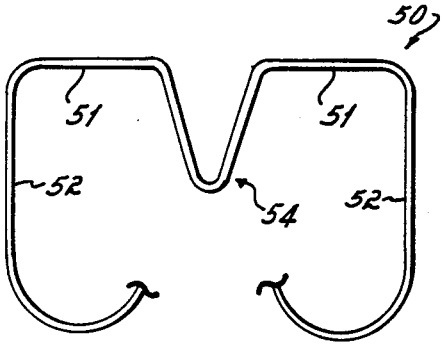
FIG. 6 is a top plan view of yet another modification of a interconnecting segment between two adjacent coils of a band of springs similar to the band of FIG. 5 but incorporating a modified supporting structure.

FIGS. 5 and 6 illustrate two different modifications of the connecting segments that can be incorporated in a band of springs generally similar to that shown in FIGS. 2 and 3. In these modifications each interconnecting segment 35, 36 is replaced by an interconnecting segment 50 of the shaped illustrated in FIGS. 5 and 6. Each interconnecting segment 50 has a bridging portion 51 similar to bridging portions 37 which extends longitudinally of the row of coil springs. Each interconnecting segment 50 also includes end portions 52 similar to the end portions 38 of the interconnecting segments 35, 36.

In place of the loop 41, however, the bridging portion 51 of FIG. 5 is formed with a supporting structure 53 of zig-zag form shaped to resemble the letter W. In the FIG. 6 embodiment, the bridging portion 51 has a supporting structure 54 shaped to resemble the letter V. In both cases the supporting structures 53 and 54 extend more than half way across the face of the band in which it lies. And in both cases, the supporting structures 53 and 54 extend upwardly from the plane of the top face of the band of springs and downwardly from the bottom face of the band of springs at the same angle A as the supporting structure 40 extended from the same planes in the embodiment of FIGS. 1–4, i.e., from 15° to 30°.

A plurality of bands of springs 22 are assembled to form a spring interior 21. FIGS. 2 and 3 show part of such a spring interior. Bands of springs 22, each similar to that shown in FIGS. 1–4, are disposed side by side, and preformed helical wires 23 are attached to them. The helical wires 23 lie in the top and bottom faces 25, 26 of the bands and extend at right angles to the longitudinal axes of the bands. Each helical wire 23 embraces one pair of closely adjacent end portions 38 of each band.

It will be seen from FIG. 2 that much of the top and bottom faces of the spring interior has the general appearance of a rectangular grid. Each of the transverse elements of the grid comprises a helical wire 23, with the end portions 38 embraced by it, and each of the longitudinal elements of the grid comprises a row of mutually aligned bridging portions 37. Within the confines of each rectangle of the grid and disposed a little lower than the grid are the upper end portions of two adjacent coil springs 31. Were it not for the presence of the supporting structures 40, 53 or 54, the top face 25 and bottom face 26 of the spring interior 21 would present relatively large rectangular apertures into which upholstery material, such as filling or padding 60 (FIG. 1), placed on top of the top face could readily enter, thereby giving rise to "cupping." The presence of the supporting structures 40, 53 or 54, however, reduces any tendency to "cupping," as the supporting structures occupy central parts of the rectangular apertures and can serve to support the upholstery material.

Figure 7:
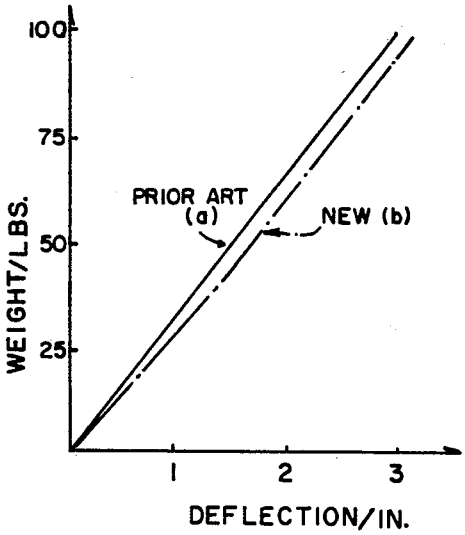
FIG. 7 is a force to deflection graph of a spring unit incorporating the invention of this application as compared to a prior art spring unit without the invention of this application.

For a comparison of the relative firmness of the spring interior 21 manufactured in accordance with the invention of this application as compared to the same spring interior 21 but with the supporting structure 40 located in the plane of the face of the spring interior, as in British Patent No. 2,143,731, the reader is referred to FIG. 7 of the drawings. In this drawing, line (b) is a plot of the deflection curve of a spring unit made in accordance with the FIG. 6 modification of this invention in which the supporting structure 54 is angled upwardly from the plane of the top face of the band. Line (a) of FIG. 7 is a plot of the deflection curve of the same spring interior 21 manufactured with the supporting structure located in the horizontal plane of the top and bottom faces of the spring interior as in British Patent No. 2,143,731. In both cases, the tested spring interiors were manufactured from 15½ gauge wire in which the supporting structure 54 extended inwardly toward the interior of the coils a distance of ¾ inch from the vertical plane of the bridging portions 51. In the case of the improved spring unit plotted on line B, the supporting structure 54 was angled at an angle A of approximately 30° upwardly from the plane of the top face of the band or the bottom face of the band such that the innermost end or nose of the supporting structure was located approximately ½ inch above the top face of the band. The deflection curves plotted in FIG. 7 were the result of tests conducted upon a conventional Indentation Load Deflection machine. Those tests established that when the test units were placed upon a rigid, flat, supporting surface with only the supporting structure on the top face of the spring unit inclined upwardly, but with the supporting structure 54 on the bottom of the unit located in the bottom face of the unit, the improved unit of this invention was:

(a) 17 percent softer than the prior art unit of British Patent No. 2,143,731 during the first ½ inch of deflection;

(b) 13 percent softer between ½ inch and 1 inch of deflection;

(c) 6 percent softer between 1 and 1½ inches of deflection; and (d) of approximately equal firmness after 1½ inches of deflection.

Otherwise expressed, it required 17 percent less force to deflect the improved spring interior 21 of this invention ½ inch than was required to effect the same deflection of an otherwise identical unit made without the invention of this application, i.e., without the upwardly inclined supporting structure 54. It required 13 percent less force to deflect the improved spring interior 21 of this invention 1 inch than was required to deflect the substantially identical unit without the invention of this application, and it required 6 percent less force to deflect the spring interior 21 of this invention 1½ inches than was required to effect the same deflection of an otherwise identical unit without the invention of this application. After 1½ inches of deflection, the same force was required to effect any further deflection between the two units. Thus, the tests depicted in the graph of FIG. 7 clearly established that simple angulation of the supporting structure 54 in the manner described hereinabove effects a markedly increased initial softness of the spring interior manufactured in accordance with the invention of this application.

The spring interiors described hereinabove can be incorporated in an article such as an upholstered mattress or seat. One or more layers of filling or padding 60 are placed against the top and/or bottom face of the spring interior and covered with a suitable cover material 61. In use, when forces are applied to the article in such a direction as to compress the springs, the support structures 40, 53 and 54 tend to resist "cupping" of the filling or padding, and because of the angulation of the supporting structures relative to the horizontal planes of the top and bottom faces of the spring interior, to impart to the unit initial softness as the supporting structures initially deflect and then increase firmness of the spring interior as the coil springs deflect.

While I have described only three preferred embodiments of my invention, persons skilled in the art to which it pertains will appreciate changes and modifications which may be made without departing from the spirit of my invention. Therefore, I do not intend to be limited except by the scope of the following appended claims:

What is claimed:

1. A bedding mattress comprising a spring interior having a plurality of bands of springs, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row, and being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands and extending across the bands, each helical wire embracing portions of wires of the bands that extend transversely of the bands from the ends of said bridging portions thereof, there being, in each face of the spring interior, two springs in the interval between each helical wire and the next, at least some of the bridging portions being shaped so as to extend not only longitudinally of the bands but also laterally thereof, the laterally extending portions constituting supporting structures, each such supporting structure being itself supported solely by and cantilevered from adjacent bridging portions of the interconnecting segments of which it forms an integral part, the spring interior being characterized by initial softness resulting from each laterally extending portion of each supporting structure of an interconnecting segment in the top face of the band extending angularly upwardly away from and returning to the top face of the band in the relaxed condition of the band of springs such that upon deflection of the band of springs, the supporting structure initially deflects downwardly into the top face of the band while the adjacent bridging portions deflect in torsion, padding overlying at least one of said main faces of said spring interior, and an upholstered covering material encasing said spring interior and said padding.

2. A spring interior comprising a plurality of bands of springs, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a ;hand opposite to the hand of the adjacent coil springs immediately before and after it in the row, and being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands and extending across the bands, each helical wire embracing portions of wires of the bands that extend transversely of the bands from the ends of said bridging portions thereof, there being, in each face of the spring interior, two springs in the interval between each helical wire and the next, at least some of the bridging portions being shaped so as to extend not only longitudinally of the bands but also laterally thereof, the laterally extending portions constituting supporting structures, each such supporting structure being itself supported solely by and cantilevered from adjacent bridging portions of the interconnecting segments of which it forms an integral part, the spring interior being characterized by initial softness resulting from each laterally extending portion of each supporting structure of an interconnecting segment in the top face of the band extending angularly upwardly away from and returning to the top face of the band in the relaxed condition of the band of springs such that upon deflection of the band of springs, the supporting structure deflects downwwardly into the top face of the band while the adjacent bridging portions deflect in torsion.

3. A spring interior comprising a plurality of bands of springs, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row, and being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, the bands being disposed side by side so that their top faces lie in a top main face of the spring interior and their bottom faces lie in a bottom main face of the spring interior, the bands being interconnected by helical wires lying in the top and bottom faces of the bands, at least some of the bridging portions being shaped so as to extend not only longitudinally of the bands but also laterally thereof, the laterally extending portions constituting supporting structures, each such supporting structure being itself supported solely by and cantilevered from adjacent bridging portions of the interconnecting segments of which it forms an integral part, the spring interior being characterized by initial softness resulting from each laterally extending portion of each supporting structure of an interconnecting segment in the top face of the band extending angularly upwardly away from and returning to the top face of the band in the relaxed condition of the band of springs such that upon deflection of the band of springs, the supporting structure deflects downwardly into the top face of the band while the adjacent bridging portions deflect in torsion,

4. A spring interior according to claim 3 characterized in that each supporting structure extends more than half way across the top or bottom face of the band of springs of which it forms a part.

5. A spring interior according to either of claims 3 and 4 characterized in that each supporting structure comprises a pair of straight portions inclined to each other.

6. A spring interior according to either of claims 3 a 4 characterized in that each supporting structure is of sinuous or zig-zag form.

7. A spring interior according to either one of claims 3 and 4 characterized in that each supporting structure is in the shape of a loop or loops of wire extending angularly from the top or bottom face of the band of springs of which it forms a part.

8. A spring interior according to claim 7 characterized in that in each band of springs the bridging portion of every interconnecting segment is formed with a single loop, and each loop of one hand is succeeded by a loop of the other hand so that all the loops in the top face of the band are of one hand while all the loops in the bottom face of the band are of the other hand.

9. A spring interior according to claim 3 characterized in that each supporting structure of an interconnecting segment in the bottom face of the band extends angularly downwardly from the adjacent bridging portions of the interconnecting segment in the relaxed condition of the band of springs such that upon deflection of the band of springs, the supporting structure deflects upwardly into the top face of the band while the adjacent bridging portions deflect in torsion.

10. An upholstered article comprising a spring interior according to either claim 3 or 4 and upholstery material overlying at least one of the main faces of said spring interior, characterized in that the upholstery material is disposed against a main face in which the bridging portions of the interconnecting segments afford supporting structures.

11. A band of springs for use in a spring interior, said band comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row, and being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row, at least some of the bridging portions being shaped so as to extend not only longitudinally of the bands but also laterally thereof, the laterally extending portions constituting supporting structures, each such supporting structure being itself supported solely by and cantilevered from adjacent bridging portions of the interconnecting segments of which it forms an integral part, the band of springs being characterized by initial softness resulting from each laterally extending portion of each supporting structure of an interconnecting segment in the top face of the band extending angularly upwardly away from and returning to the top face of the band in the relaxed condition of the band of springs such that upon deflection of the band of springs, the supporting structure deflects downwardly into the top face of the band while the adjacent bridging portions deflect in torsion.

12. The band of springs of claim 11 characterized in that each laterally extending portion of each supporting structure of an interconnecting segment in the bottom face of the band extends angularly downwardly away from and returns to the bottom face of the band in the relaxed condition of the band of springs such that upon deflection of the band of springs, the supporting structure deflects upwardly into the bottom face of the band while the adjacent bridging portions deflect in torsion.

13. A spring interior comprising a plurality of longitudinally extending bands of springs disposed side by side and connected together by helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion and a supporting structure located medially of said bridging portion, said supporting structure including at least one laterally extending portion, each of said laterally extending portions in the top face of the bands being angled upwardly away from and returning to the top face of the band and each of the laterally extending portions in the bottom face of the bands being angled downwardly away from and returning to the bottom face of the band so as to impart initial softness to the spring interior when the spring unit is vertically compressed.

14. A spring interior comprising a plurality of longitudinally extending bands of springs disposed side by side and connected together by helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion and a support structure located medially of the bridging portion, each of said support structures including at least one laterally extending portion, each of said laterally extending portions located in the top face of each band being angled upwardly away from and returning to the top face of the band so as to impart initial softness and subsequent increased firmness to the spring interior when the spring unit is vertically compressed.

* * * * *

UNITED STATES PATENT AND TRADEMARK OFFICE

CERTIFICATE OF CORRECTION

PATENT NO. : 4,905,333

DATED : March 6, 1990

INVENTOR(S) : Terence A. Scott

It is certified that error appears in the above-identified patent and that said Letters Patent is hereby corrected as shown below:

On the title page, in item [57] ABSTRACT, line 6, "vertical" should be --vertical coils of springs--.

On the title page, in item [57] ABSTRACT, line 7, delete "coils of springs."

Column 11, line 1, "claims 3 a 4" should read --claims 3 and 4--.

Signed and Sealed this

Eleventh Day of June, 1991

*Attest:*

*Attesting Officer*

HARRY F. MANBECK, JR.

*Commissioner of Patents and Trademarks*